US005852393A

United States Patent [19]

Reznik et al.

[11] Patent Number: 5,852,393

[45] Date of Patent: Dec. 22, 1998

[54] APPARATUS FOR POLARIZING RARE-EARTH PERMANENT MAGNETS

[75] Inventors: Svetlana Reznik, Rochester; Edward P. Furlani, Lancaster; William E. Schmidtmann, Naples, all of N.Y.

[73] Assignee: Eastman Kodak Company, Rochester, N.Y.

[21] Appl. No.: 866,996

[22] Filed: Jun. 2, 1997

[51] Int. Cl.[6] ..... H01F 7/20

[52] U.S. Cl. ..... 335/284; 335/300

[58] Field of Search ..... 335/284, 296–300; 148/103, 108, 121; 361/143, 147

[56] References Cited

U.S. PATENT DOCUMENTS 3,488,576 1/1970 McIntire et al. ..... 335/284
4,470,031 9/1984 Steingroever et al. ..... 335/284
4,497,011 1/1985 Hurtig ..... 361/147
4,920,326 4/1990 Agarwala ..... 335/284

*Primary Examiner*—Lincoln Donovan
*Attorney, Agent, or Firm*—Pamela R. Crocker

[57] ABSTRACT

Apparatus for polarizing a multipole permanent magnet having a main surface is disclosed. The apparatus includes a support member for supporting the magnet; and conductive tubular elements in the form of a coil, the tubular elements being mounted on the support member in relation to the magnet so that the tubular elements produce a magnetizing field across the surface of the magnet to polarize such magnet when the tubular elements are energized. The apparatus further includes circuitry for energizing the tubular elements to produce the magnetizing field to polarize the magnet, and a structure for circulating coolant through the tubular elements to limit the heat build-up of the tubular elements when the tubular elements are energized.

17 Claims, 3 Drawing Sheets

APPARATUS FOR POLARIZING RARE-EARTH PERMANENT MAGNETS

FIELD OF THE INVENTION

The present invention relates to magnets, and in particular, to apparatus for polarizing rare-earth permanent magnets.

BACKGROUND OF THE INVENTION

FIG. 1A shows an axially-polarized ring magnet 12 having multiple poles on both surfaces of the magnet 12. FIG. 1B shows a typical prior art apparatus 10 for polarizing a permanent magnet, such as the magnet 12 of FIG. 1A. The apparatus 10 includes a support member 14 which receives the unpolarized magnet and supports it is place. The support member 14 includes a top portion 14*a* and a bottom portion 14*b* with the magnet 12 being positioned between the two portions 14*a* and 14*b* so that both surfaces of the magnet 12 are polarized. Typically the support member 14 is made from a material such as fiberglass, POM/derlin, phenol-paper, Plexiglas, or iron. Conductive elements 16 are threaded through the support member 14 so that the conductive elements 16 are close to each surface of the magnet 12 when it is enclosed in the support member 14. The conductive elements 16, which are typically standard gauge wires, produce a magnetizing field when energized. The conductive elements 16 are threaded in the support member 14 in a manner so as to produce the desired surface polarization.

To polarize a permanent multipole magnet, a high current, often exceeding 10,000 amps, is forced through the conductive elements 16 over a short period of time, for example, on the order of a millisecond. The field produced by the energized wires cuts across the surface of the magnet in such a way so as to render the desired pole structure on its surface.

Conventional polarizing apparatus, such as the apparatus 10 shown in FIG. 1B, are adequate for polarizing ferrite-based materials or AlNiCo, which do not require high current levels to polarize the material. However, such apparatus are inadequate for polarizing modem high strength, rare-earth materials, such as neodymium-iron-boron or samarium-cobalt. Rare-earth magnets are advantageous because they can be magnetized to a much higher field-strength than traditional Ferrite or AlNiCo magnets. However, rare-earth magnets require anywhere from two to four times higher magnetizing field-strength than Ferrite magnets. Rare-earth materials have very high coercivity, and therefore, require high magnetizing fields on the order of 40,000 Gauss to magnetize the materials to saturation. To achieve the high magnetizing fields, a very high transient current, i.e., 100,000 Amps, must be generated through the wires that are threaded through the support member of the polarizing apparatus. The high current levels give rise to significant heating which degrades the apparatus, making it unusable after only a few magnetizations. Excessive thermal stress can also cause the polarizing apparatus to self destruct during the magnetization process.

Various methods have been employed to reduce the heating caused by the high current levels in order to extend the useful life of the polarizing apparatus, including water cooling or air cooling. Such methods, however, require additional tubing to be threaded through the support member. These methods also require the use of sine wave impulse charging, which is accomplished by switching the current flow through thyristors to change the current flow through the apparatus and then return to recharge the capacitors with an opposite polarity. The capacitors then discharge through ceramic resistors. However, the use of sine wave impulse charging results in 30 percent to 70 percent of the energy being converted into heat. This is not an efficient energy transfer process.

SUMMARY OF THE INVENTION

Accordingly, it is an object of the present invention to provide apparatus for polarizing high strength rare-earth permanent magnets having an extended useful life.

This object is achieved by apparatus for polarizing a multipole permanent magnet having a main surface, comprising:

(a) a support member for supporting the magnet;

(b) conductive tubular elements in the form of a coil, the tubular elements being mounted on the support member in relation to the magnet so that the tubular elements produce a magnetizing field across the surface of the magnet to polarize such magnet when the tubular elements are energized;

(c) means for energizing the tubular elements to produce the magnetizing field to polarize the magnet; and (d) means for circulating coolant through the tubular elements to limit the heat build-up of the tubular elements when the tubular elements are energized.

ADVANTAGES

An advantage of the present invention is to provide polarizing apparatus for polarizing a multipole magnet in which the same components are used to generate the magnetic field and to cool the apparatus, thereby extending its effective life.

Another advantage of the present invention is that apparatus is provided which permits the polarization of rare earth magnetic materials. Rare-earth magnetic materials can provide magnets which produce high field strength.

DETAILED DESCRIPTION OF THE PREFERRED EMBODIMENT

Figure 1A:
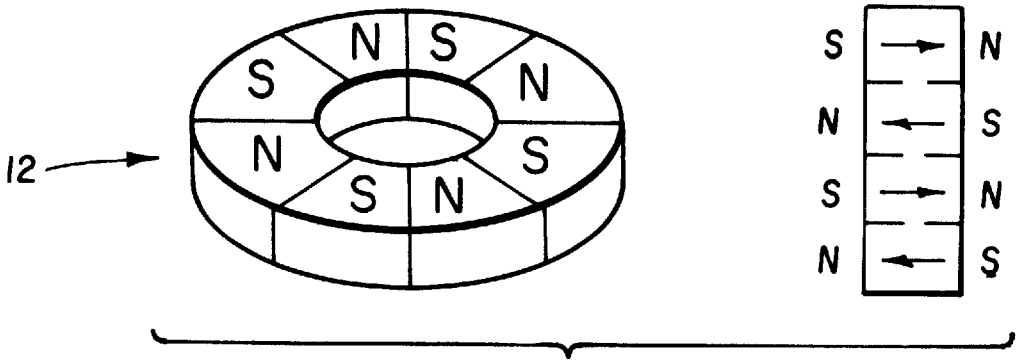
FIG. 1A (prior art)
FIG. 1 is a diagram of an axially-polarized multipole magnet.
FIG. 1B is an exploded view of a typical prior art apparatus for polarizing the magnet of FIG. 1A.
Figure 1B:
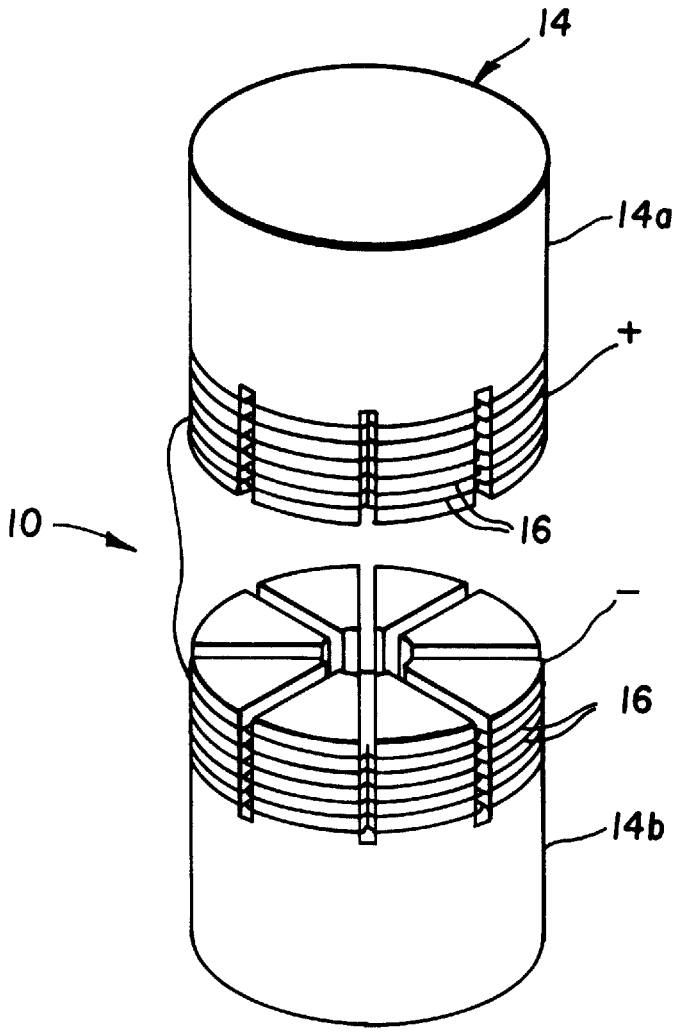
FIG. 1B (prior art)
Figure 2A:
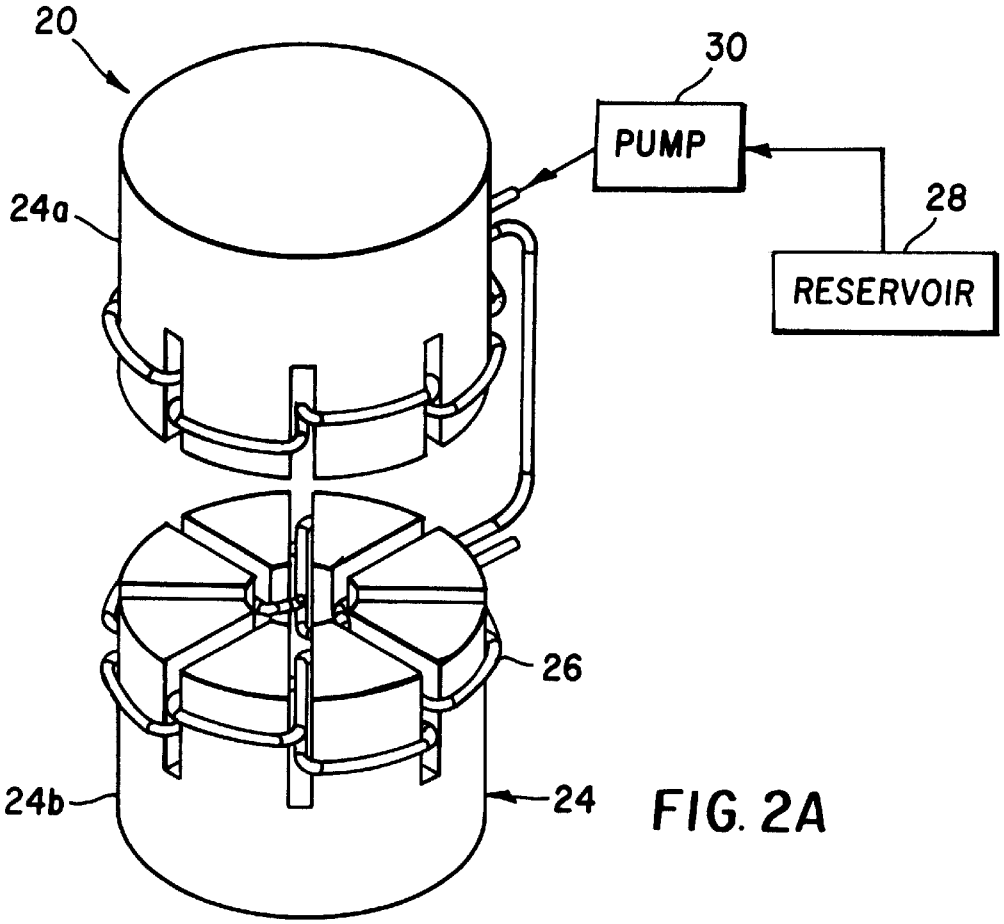
FIG. 2A is an exploded view of a polarizing apparatus in accordance with the present invention.
Figure 2B:
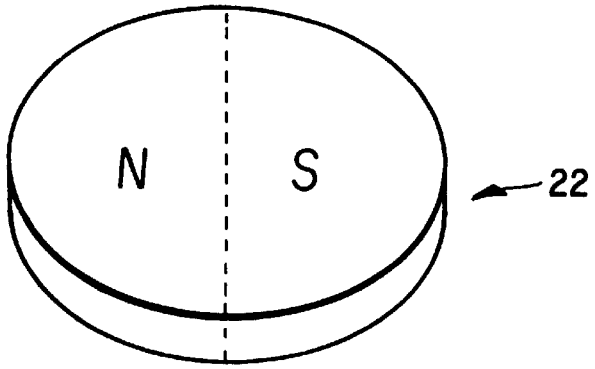
FIG. 2B is a diagram of a flat disk-shaped magnet which is polarized using the polarization apparatus of FIG. 2A.

Referring to FIG. 2A, an apparatus 20 is shown for magnetizing multipole permanent magnets in accordance with the present invention. The apparatus 20 can be used to magnetize a flat disk-shaped magnet 22 having north and south surface poles, as shown in FIG. 2B. The apparatus 20 includes a support member 24 for mounting the unpolarized magnet 22. The support member 24 includes a top portion 24*a* and a bottom portion 24*b* with the magnet 22 being positioned between the two portions 24*a* and 24*b* so that both surfaces of the magnet 22 are polarized. Preferably, the support member 22 is made from a material such as phenolic or mild steel. It will be understood to those skilled in the art that a magnet with poles on only one surface can be polarized using one portion of the support member 24.

Conductive elements 26 are threaded through each portion 24*a* and 24*b* of the support member 24. When energized, the conductive elements 26 produce a magnetic field across each surface of the magnet 22 which polarizes the magnet 22. In accordance with the present invention, the conductive elements 26 are tubular in shape, and preferably are made of copper. The conductive elements 26, which are hereinafter referred to as conductive tubing 26, are fixed or "potted" to the support member 24 by a high temperature adhesive material. The adhesive material can be, for example, a high-temperature epoxy or ceramic material, or a nonconductive phenolic material. Potting the conductive tubing 26 to the support member 24 prevents movement and touching of the conductive tubing 26 which could eventually cause a short-circuit. The conductive tubing 26 is connected to a reservoir 28 for providing coolant (not shown) to the conductive tubing 26. The coolant can be, for example, air, oil, liquid nitrogen, or water. A pump 30, which is connected to the reservoir 28, is used to force coolant from the reservoir 28 through the conductive tubing 26 during the magnetization process.

Figure 3:
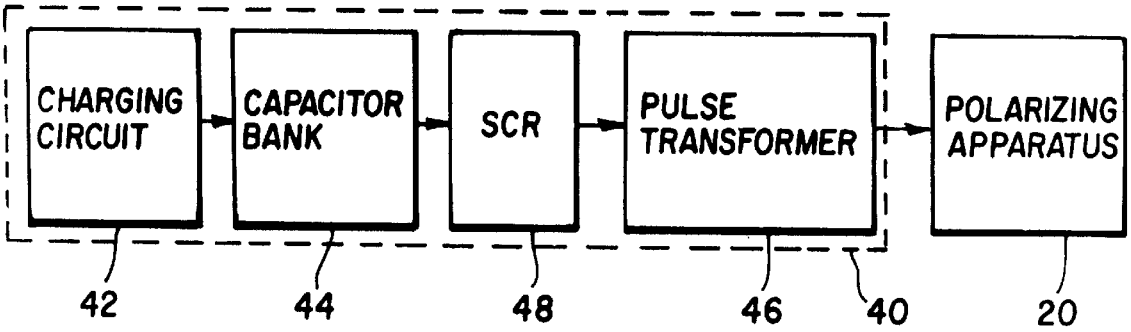
FIG. 3 is a block diagram of a magnetizer which can be used in conjunction with the polarizing apparatus in accordance with the present invention.

Referring to FIG. 3, a block diagram of a magnetizer 40 is shown which can be used to energize the conductive tubing 26 of the polarizing apparatus 20 in accordance with the present invention. The magnetizer 40, which is well known to those skilled in the art, includes a charging circuit 42 which charges a capacitor bank 44. Once the capacitor bank 44 is charged, an unpolarized magnet (not shown) is placed between the two portions 24*a* and 24*b* of the support member 24 of the polarizing apparatus 20. The unpolarized magnet can be held in position by, for example, clamps or weights (not shown) which are attached to the support member 24. As shown in FIG. 3, the polarizing apparatus 20 is connected to a pulse transformer 46, which is connected to the capacitor bank 44 through a silicon-controlled rectifier (SCR) 48. Although an SCR is preferred, it will be understood that an Ignitron tube or a thyristor can also be used. To polarize the magnet, a switch (not shown) is thrown which energizes the SCR 48. Once the SCR 48 is energized, the charge that is stored on the capacitor bank 44 flows through the pulse transformer 46 to the polarizing apparatus 20. A high transient current (on the order of 100,000 amps) continues to flow through the conductive tubing 26 for approximately one millisecond, causing the conductive tubing 26 to produce a magnetizing field across each surface of the magnet to create the north and south surface poles on each surface of the magnet, as shown in FIG. 2B. While the current is flowing through the conductive tubing 26, the pump 30 forces coolant from the reservoir 28 through the conductive tubing 26 to reduce the heating of the polarizing apparatus 20 caused by the high current levels, and thereby extends the useful life of the polarizing apparatus 20.

The polarizing apparatus 20 is particularly useful for the continual use of polarizing successive magnetics made of high strength rare-earth materials, such as NdFeB, which require a very high transient current to magnetize the material. The level of current required to produce the desired magnetizing field can be determined experimentally or theoretically in a manner well known in the art.

Figure 4:
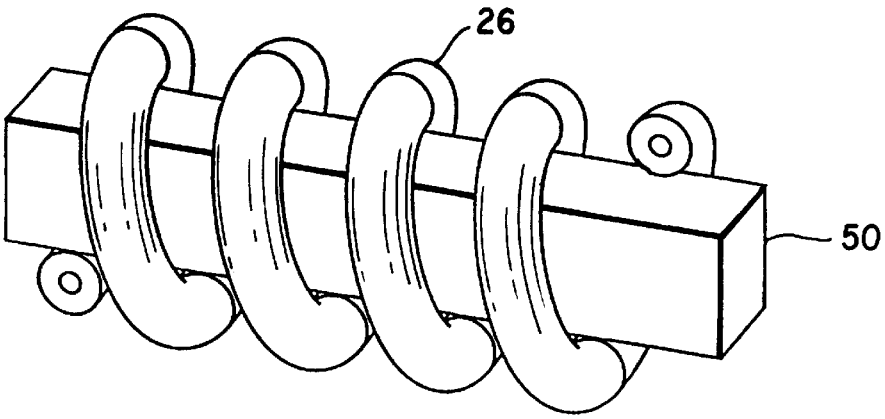
FIG. 4 is another embodiment of the polarizing apparatus in accordance with the present invention.

The present invention has been described with reference to the polarization of a flat disk-shaped magnet having north and south surface poles on each surface of the magnet, as shown in FIG. 2B. The configuration of the conductive tubing 26 is in accordance with the pole structure of the flat disk-shaped magnet 22 of FIG. 2B. It will be understood by those skilled in the art that the configuration of the conductive tubing 26 can vary depending on the shape of the magnet to be polarized and the desired pole structure. For example, referring to FIG. 4, an alternative configuration of the conductive tubing 26 is shown which can be used to magnetize a bar magnet 50 along its axis.

The invention has been described in detail with particular reference to a preferred embodiment thereof. However, it will be appreciated that variations and modifications can be effected by a person of ordinary skill in the art without departing from the spirit and scope of the invention.

PARTS LIST

10 apparatus
12 magnet
14 support member
16 conductive element
20 apparatus
22 magnet
24 support member
24*a* top portion
24*b* bottom portion
26 conductive element
28 reservoir
30 pump
40 magnetizer
42 charging circuit
44 capacitor bank
46 pulse transformer
48 silicon-controlled rectifier
50 bar magnet

What is claimed is:

1. Apparatus for polarizing a multipole rare-earth permanent magnet having a main surface, comprising:

(a) a support member for supporting the magnet;

(b) conductive tubular elements in the form of a coil, the tubular elements being mounted on the support member in relation to the magnet so that the tubular elements produce a magnetizing field across the surface of the magnet sufficient to polarize such magnet when the tubular elements are energized;

(c) means for energizing the tubular elements to produce the magnetizing field to polarize the magnet; and (d) means for circulating coolant through the tubular elements to limit the heat build-up of the tubular elements when the tubular elements are energized.

2. The apparatus of claim 1 wherein the energizing means includes means for producing a high voltage across the tubular elements to provide a sufficient magnetizing field to cause the magnet to be polarized.

3. The apparatus of claim 1 wherein the multipole permanent magnet includes a rare-earth material which requires a high magnetizing field to cause the magnet to be polarized.

4. The apparatus of claim 3 wherein the rare-earth material includes samarium cobalt.

5. The apparatus of claim 3 wherein the rare-earth material includes neodymium iron boron.

6. The apparatus of claim 1 wherein the support member includes a nonconductive phenolic material.

7. The apparatus of claim 1 wherein the support member includes a high temperature ceramic material.

8. The apparatus of claim 1 wherein the support member includes mild steel.

9. The apparatus of claim 1 wherein the conductive tubular elements are copper tubing.

10. Apparatus to polarizing a multipole permanent rare-earth magnet having a main surface, comprising:

(a) a support member for supporting the rare-earth magnet;

(b) conductive tubular elements in the form of a coil, the tubular elements being mounted on the support member in relation to the rare-earth magnet so that the tubular elements produce a high magnetizing field across the surface of the rare-earth magnet sufficient to polarize such magnet when the tubular elements are energized;

(c) means for energizing the tubular elements to produce a high voltage across the tubular elements to provide the high magnetizing to polarize the rare-earth magnet; and (d) means for circulating coolant through the tubular element to limit the heat build-up of the tubular elements when the tubular elements are energized.

11. The apparatus of claim 10 wherein the rare-earth magnet includes samarium cobalt.

12. The apparatus of claim 10 wherein the rare-earth magnet includes neodymium-iron-boron.

13. The apparatus of claim 10 wherein the support member includes a nonconductive phenolic material.

14. The apparatus of claim 10 wherein the support member includes a high temperature ceramic material.

15. The apparatus of claim 10 wherein the support member includes mild steel.

16. The apparatus of claim 10 wherein the conductive tubular elements are copper tubing.

17. An apparatus for polarizing a rare-earth permanent magnet having a surface, comprising a conductive tube associated with the surface and simultaneously carrying an electric current and a flowing coolant, the current producing a magnetizing field across the surface of the magnet sufficient to polarize the rare-earth permanent magnet and the coolant absorbing heat produced responsive to the production of the field by the current.

* * * * *

UNITED STATES PATENT AND TRADEMARK OFFICE

CERTIFICATE OF CORRECTION

PATENT NO. : 5,852,393
DATED : December 22, 1998
INVENTOR(S) : Svetlana Reznik, et alSvetlana Reznik, et al It is certified that error appears in the above-identified patent and that said Letters Patent is hereby corrected as shown below:

| | |
|---|---|
| Claim 10, line 1 | Delete "to" and substitute --for--. |
| Claim 10, line 13 | After "magnetizing" please insert --field--. |
| Claim 10, line 16 | Delete "element" (first occurrence) and substitute --elements--. |

Signed and Sealed this

Twenty-seventh Day of April, 1999

*Attest:*

Q. TODD DICKINSON

*Attesting Officer*

*Acting Commissioner of Patents and Trademarks*